US005238157A

United States Patent [19]

Gentile

[11] Patent Number: 5,238,157

[45] Date of Patent: Aug. 24, 1993

[54] SQUEEZEABLE CONTAINER AND INTEGRAL CAP FORMED FROM A LAMINATED FLAT BLANK

[76] Inventor: Aliseo Gentile, 8011 Schneider, Manchester, Mich. 48158

[21] Appl. No.: 945,015

[22] Filed: Sep. 15, 1992

Related U.S. Application Data

[63] Continuation of Ser. No. 705,354, May 24, 1991, abandoned.

[51] Int. Cl.[5] ..... B65D 47/10

[52] U.S. Cl. ..... 222/541; 222/107

[58] Field of Search ..... 222/94, 106, 107, 491, 222/494, 541, 545

[56] References Cited

U.S. PATENT DOCUMENTS

| | | | |
|---|---|---|---|
| 1,522,246 | 1/1925 | Jefferson | 222/94 |
| 4,319,701 | 3/1982 | Cambio | 222/541 |
| 4,394,936 | 7/1983 | Shavit | 222/107 |
| 4,512,475 | 4/1985 | Federighi | 222/541 X |
| 4,669,253 | 6/1987 | Shavit | 53/455 |
| 4,717,046 | 1/1988 | Brogli | 222/491 X |
| 4,792,060 | 12/1988 | Brogli | 222/107 |
| 4,917,267 | 4/1990 | Laverdure | 222/541 X |

FOREIGN PATENT DOCUMENTS

| | | | |
|---|---|---|---|
| 538036 | 4/1955 | Belgium , | |
| 3143671 | 5/1983 | Fed. Rep. of Germany . | |
| 713629 | 8/1954 | United Kingdom | 222/94 |

*Primary Examiner*—Gregory L. Huson
*Attorney, Agent, or Firm*—James M. Deimen

[57] ABSTRACT

The new integral cap and container comprise an extended neck and enlarged head portion, the halves of which are formed as integral parts of the flat blank of container material. No additional steps are required to form, fill and cap the container beyond that of the container absent the cap. The neck and integral cap of the filled and sealed container are substantially flat. The new cap and container is opened by merely tearing off the cap and squeezing to dispense the contents. To reclose, the torn-off cap is merely slid over the substantially flat neck subsequent to release of the squeezing pressure on the container. The cap squeezes the neck together to provide a positive closure.

7 Claims, 1 Drawing Sheet

SQUEEZEABLE CONTAINER AND INTEGRAL CAP FORMED FROM A LAMINATED FLAT BLANK

This is continuation of copending application Ser. No. 07/705,354 filed on May 24, 1991 now abandoned.

BACKGROUND OF THE INVENTION

The field of the invention pertains to squeezeable containers for dispensing liquids, pastes and semi-solids, and solids in discrete particles and tablets for example. In particular, the invention pertains to containers with tear off tabs to open or unseal.

Although not limited thereto, the invention is directed to squeezeable containers such as those automatically formed and filled on machines such as disclosed in U.S. Pat. No. 4,669,253 and Belgian Pat. No. 538036. The containers are typically formed from flat blanks of paperboard coated with plastic and metal for impermeability. The blanks are folded, heat sealed and filled on the machine to form a sturdy, impermeable container with a shape best illustrated in U.S. Pat. No. 4,717,046 and German Patent Document 3143671. These containers are completely sealed until the tear-off tab is removed whereupon the contents may be dispensed. With most viscous or particulate contents the container is squeezed to dispense the quantity desired. Release of the squeeze allows the torn opening to close and effectively retain the remaining contents therein.

Effective as the above containers are, certain container materials do not adequately close upon release of the squeezing pressure thereby allowing the contents to leak or dribble from the torn opening. This condition arises usually from a combination of inviscid liquid contents and a very stiff container material or the opening design illustrated in U.S. Pat. No. 4,717,046. A further problem arises where the opening area must remain hygienically clean or sterile. U.S. Pat. No. 4,394,936 discloses a squeezeable container fitted with a separate threaded rigid opening and a threaded cap for the opening. While effective, the two additional molded parts add considerably to the cost of the container and to the manufacturing steps as is amply shown in the patent disclosure. Thus, a replaceable cap that does not add to the manufacturing steps or add appreciable cost is a most desirable goal to which the following invention is directed.

SUMMARY OF THE INVENTION

The new integral cap comprises an extended neck and enlarged head portion, the halves of which are formed as integral parts of the flat blank of container material. No additional steps are required to form and fill the container. The neck and integral cap of the filled and sealed container are substantially flat.

The new container is opened by merely tearing off the cap and squeezing to dispense the contents. To reclose, the torn-off cap is merely slid over the substantially flat neck subsequent to release of the squeezing pressure on the container. The cap squeezes the neck together to provide a positive closure and only the interior of the cap contacts the exterior of the neck at the torn opening. Thus, the integral tear-off cap keeps the opening area hygienically clean and sterile, if necessary.

DESCRIPTION OF THE PREFERRED EMBODIMENT

Figure 1:
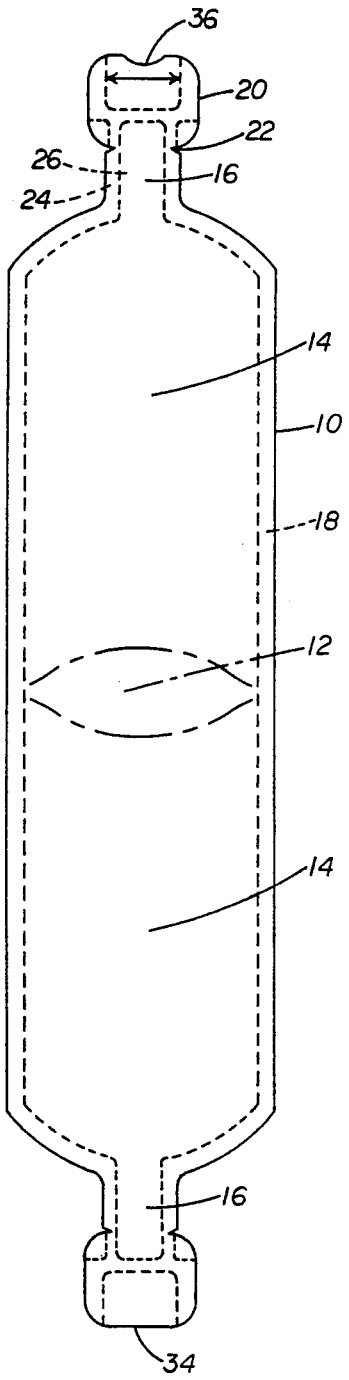
FIG. 1 illustrates a flat container blank including the new integral cap halves.

Illustrated in FIG. 1 is a flat blank 10 formed from stiff paper or cardboard that has been coated with plastic, metal foil or other materials to provide a package that is impermeable and completely inert with respect to the package contents and the environment. As appropriate the package may be formed of materials that are eventually biodegradable or recyclable. The blank 10 includes a central area 12 (shown ghosted) that forms the package bottom and sides 14 extending from the central area. As shown the blank 10 is substantially symmetrical about the central area 12. Extending from each side 14 is a neck 16.

Figure 2:
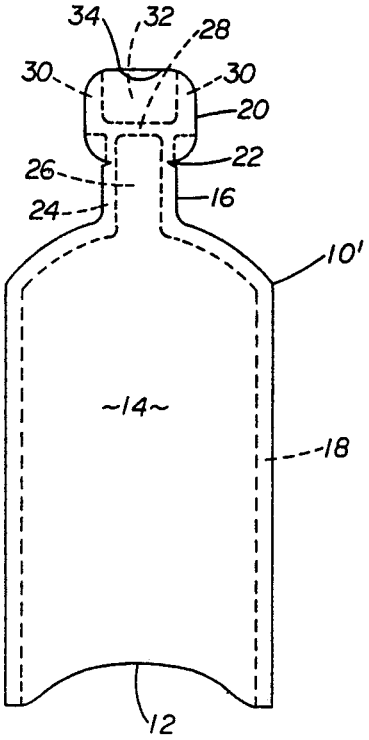
FIG. 2 illustrates in front view the formed, filled and sealed container.

Utilizing a machine for folding, sealing and filling such as disclosed in U.S. Pat. No. 4,669,253 but not limited thereto, the blank 10 is transformed into a package 10' as illustrated in FIG. 2. The dotted lines 18 in FIG. 1 and FIG. 2 indicate the edges where the opposite sides 14 are heat sealed together to form the package. The opposite sides otherwise generally bow outwardly to create the necessary hollow volume for the contents.

The blank 10 and subsequent package 10' are formed with a cap 20 separated from the neck 16 by slight notches 22 at each edge of the blank. The notches 22 only extend partly into the sealed edges 24 of the neck thus retaining the hollow area 26 in the neck 16 and cap 20 intact and sealed. The flat sides of the cap 20 include a heat sealed crossbar 28 that completes the seal of the unopened package 10'. The crossbar 28 in combination with the heat sealed cap edges 30 form an unsealed area 32 open to the top at 34. The opening is slightly greater between the heat sealed edges 30 than the width of the flat sides of the neck 16.

Figure 3:
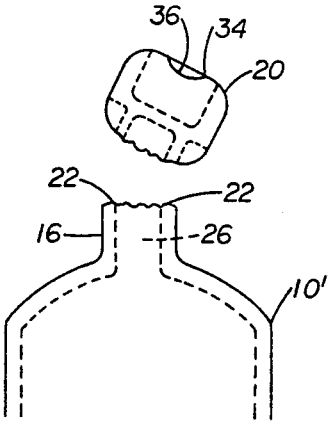
FIG. 3 illustrates the container with the integral cap torn therefrom.

As shown in FIG. 3 the package 10' is opened by tearing across the neck 16 at the notches 22 which opens the hollow area 26 of the neck and allows the contents to be dispensed. Typically, the package 10' is squeezed to dispense and upon release the sides of the neck 16 tend to close the hollow area 26. The new cap 20, however, provides a complete closure when the contents are only partially dispensed.

Figure 4:
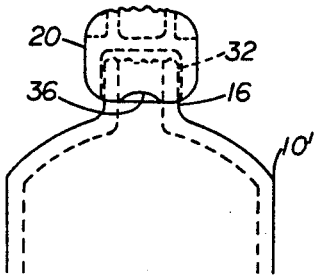
FIG. 4 illustrates the container with the cap replaced onto the container.

The cap 20, although formed of two flat sides and heat sealed at the crossbar 28 and edges 30, can be opened at the top 34 an amount sufficient to fit the unsealed area 32 over the neck 16 as shown in FIG. 4. The slight dip 36 in one side of the top 34 of the cap 20 assists in opening the area 32 to form an aperture for placement over the neck 16. The cap 20, being a part of the blank 10 and being heat sealed simultaneously with the formation and filling of the package 10', offers distinct advantages of economy, there being no additional manufacturing operations and only a small increase in packaging material for the blank.

Because the aperture area 32 is expanded to fit over the neck 16, the cap 20 fits tightly, however, if so desired a small piece of adhesive tape can be added to assure closure is retained despite dropping or otherwise mishandling of the reclosed package.

I claim:

1. A flat blank for forming a single container with an integral replaceable cap comprising; an elongated shape of long sides and short ends foldable to provide a bottom and side walls of a container, the blank having at each of the short ends a relatively narrow neck half portion extending integrally therefrom and a cap half portion extending integrally from the neck half portion, the cap half portion having at least one dimension greater than the width of the neck half portion and one cap half portion formed with a recess in one edge thereof to assist in opening a cap formed from the blank cap halves.

2. The flat blank of claim 1 wherein at least one notch is formed in one of said neck half portions.

3. The flat blank of claim 1 wherein each said cap half portion greater dimension is substantially parallel to the short ends of the blank.

4. A container with an integral replaceable cap folded from a flat blank, the container comprising a bottom and opposed sides, said sides sealed together along the edges thereof, a top edge on the container and a neck having edges and extending integrally from the top, the edges of the top and neck being sealed to form a hollow area in the neck extending from the hollow container, a flat closed integral cap extending from the neck by a separable connection, the cap and neck being formed from the flat blank and the cap being partially sealed to leave a portion of the cap edge closed but unsealed whereby the unsealed portion of the cap may be opened to form an aperture of sufficient size to enclose the open neck upon separable removal of the cap from the neck.

5. The container of claim 4 including at least one notch formed in the neck, the hollow area in the neck extending beyond the notch toward the cap.

6. The container of claim 4 wherein the hollow area in the neck extends into the cap and the cap is sealed between the neck hollow area and the unsealed portion of the cap.

7. The container of claim 4 wherein the unsealed portion of the cap includes a recess formed into one side of the unsealed portion of the cap edge to assist in opening the cap.

* * * * *